United States Patent [19]

Wilkerson

[11] Patent Number: 4,511,062

[45] Date of Patent: Apr. 16, 1985

[54] CANISTERS FOR PRESSURIZED GAS AND PERSONAL SECURITY DEVICES UTILIZING SAME

[76] Inventor: William E. Wilkerson, 10201 Harwin, Iown Park-110, Houston, Tex. 77036

[21] Appl. No.: 306,528

[22] Filed: Sep. 28, 1981

[51] Int. Cl.[3] ..... B67D 5/08; B65D 83/14

[52] U.S. Cl. ..... 222/47; 222/175; 222/182

[58] Field of Search ..... 222/41, 47, 49, 402.12, 222/175, 402.1, 173, 182, 402.13, 402.15; 224/242, 245, 914; 150/7, 34, 52 R

[56] References Cited

U.S. PATENT DOCUMENTS

| | | | |
|---|---|---|---|
| Re. 24,208 | 9/1956 | Steiner | 222/47 |
| D. 227,099 | 6/1973 | Barrow | D22/13 |
| D. 256,266 | 8/1980 | Sorgnard | D22/14 |
| 1,603,861 | 8/1925 | Mundis | 150/52 R |
| 1,876,613 | 9/1932 | Clark | 224/236 |
| 3,006,510 | 10/1961 | Sagarin | 222/182 |
| 3,107,033 | 10/1963 | Sanborn | 222/41 |
| 3,339,608 | 9/1967 | Brenner | 150/52 |
| 3,450,313 | 6/1969 | Jonas | 222/175 |
| 3,589,570 | 6/1971 | Gach | 222/402.13 |
| 4,162,029 | 7/1979 | Gottsegen et al. | 222/143 |
| 4,301,947 | 11/1981 | Potter | 222/182 |
| 4,324,351 | 4/1982 | Meshberg | 222/402.12 X |
| 4,434,914 | 3/1984 | Meshberg | 222/402.13 X |

*Primary Examiner*—Joseph J. Rolla
*Assistant Examiner*—Andrew Jones
*Attorney, Agent, or Firm*—Shapiro and Shapiro

[57] ABSTRACT

Hand-held tear gas canisters and personal security devices utilizing same are herein disclosed. A tactile element, preferably in the form of an elongate ridge or rib, is provided on the outer surface of the canister, or on a holster which receives the canister, to facilitate orientation of the canister with a gas discharge nozzle thereof pointing away from the user. In use, by feeling the position of the ridge or rib, the user will be aware of the direction of gas discharge and can thereby avoid misdirection of the gas.

1 Claim, 5 Drawing Figures

CANISTERS FOR PRESSURIZED GAS AND PERSONAL SECURITY DEVICES UTILIZING SAME

BACKGROUND OF THE INVENTION

This invention relates to canisters for pressurized gas and personal security devices utilizing such canisters.

One known form of personal security device comprises a portable tear gas canister adapted to be carried in a coat pocket or handbag and used, in case of an emergency, in order to discharge tear gas, for example, toward the face of an assailant. The device is sufficiently small to be grasped in one hand, with discharge of the gas generally being effected through a gas discharge nozzle under the control of a plunger operated by thumb pressure. The canister may be mounted in a holster, and known holsters comprise, for example, a pair of panels of flexible material, such as leather, seamed together along three edges to define a canister pocket. One panel may include a flap passing over the canister plunger and secured to the other panel by a single snap fastener, the arrangement being such that the plunger can be depressed by applying pressure on top of the flap.

Problems may arise with a device of the above type. For example, in an emergency situation, where extreme speed of operation is required, a user in making a garb for the device in his or her pocket or bag, may grasp and operate it in an incorrect orientation, resulting in possible misdirection of the gas discharge. In such circumstances, the gas may even be directed toward the user rather than toward the assailant. Further, the holster flap may tend to pivot about the single snap fastener, thereby interfering with proper operation of the canister plunger.

SUMMARY OF THE INVENTION

According to the present invention, at least in one aspect thereof, a personal security device of the type described includes means for protecting against misdirected release of gas comprising tactile means on an outer surface of the device adapted to be oriented relative to the gas discharge nozzle to facilitate gripping of the device with the nozzle pointing away from the user.

In one preferred form of the invention, for example, the security device may comprise a holster adapted snugly to receive a tear gas or like canister, the holster including the tactile means which may be in the form of an elongate ridge distinguishable by feel from the remainder of the holster and adapted to align with the gas discharge nozzle of the canister when the canister is accommodated in the holster. The arrangement is such as to promote gripping of the holster, with the ridge running down the inside of a user's fingers so that the aligned discharge nozzle points away from, rather than toward, the user. The holster may, for example, be formed from a one-piece blank of suitable flexible material, e.g., leather, vinyl or the like, opposite edges of which are brought together and seamed to form the ridge.

According to a further feature of the invention, the holster may include a fold-over flap adapted to pass over the canister plunger and be releasably fastened to the main body of the holster by a pair of snap fasteners or the like. The use of a pair, rather than a single snap fastener, is an advantage, as will be described.

In accordance with another aspect of the invention, the body of a canister for pressurized gas, which is adapted to be released from the canister through a plunger-operated discharge nozzle, is itself provided with tactile means for facilitating gripping of the canister by a user, with the discharge nozzle pointing away from the user. The tactile means may in this case, for example, comprise a vertical finger-locating rib formed integrally with, or attached to, the canister body. It will be unerstood that the canister, when filled with tear gas or the like, may per se be used to advantage as a personal security device in the manner previously described.

Additional features and advantages of the invention will be apparent from the ensuing description and claims taken in conjunction with the attached drawings.

DESCRIPTION OF PREFERRED EMBODIMENTS

Figure 1:
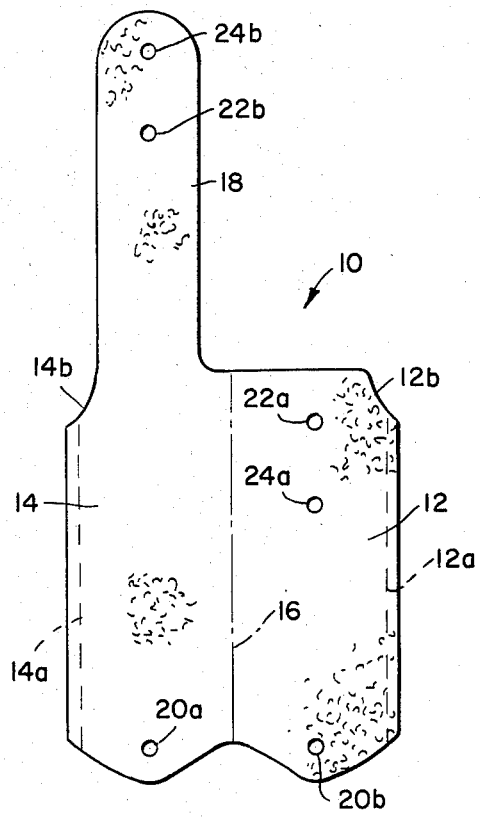
FIG. 1 is an elevational view of a blank for forming the holster for a personal security device in accordance with the invention.

Referring initially to FIG. 1, there is shown a holster blank 10, which may be cut or stamped from suitable material such as leather or vinyl, for example. The blank is shaped to provide main body panels 12 and 14, and a fold over flap 18. The blank may also include stampings 20*a* and 20*b* for receiving an eyelet fastener, and stampings 22*a*, 22*b*, 24*a*, 24*b* for a pair of snap fasteners.

Figure 2:
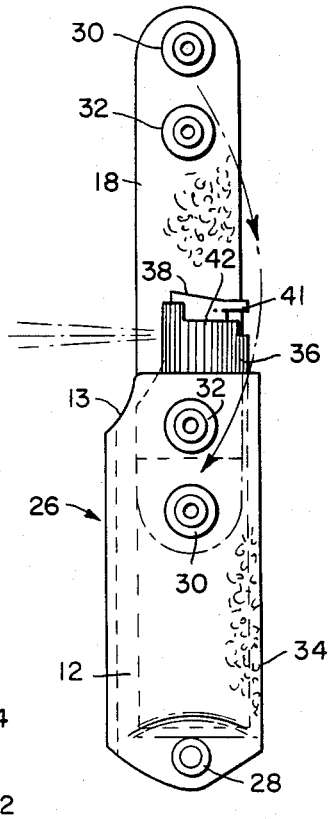
FIG. 2 is an elevational view of a personal security device comprising a holster made from the blank of FIG. 1, and a tear gas canister received therein.
Figure 3:
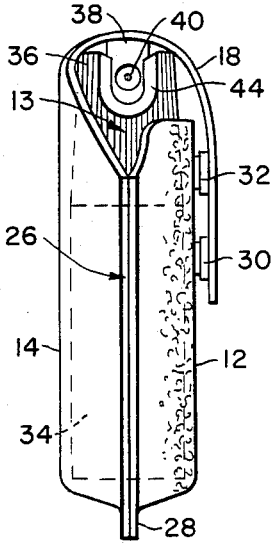
FIG. 3 is a side elevational view from the left of FIG. 2, with a holster flap being shown in the closed position.

In making blank 10 up into an elongate holster, panels 12 and 14 are folded in the region of line 16 and their opposite edge portions are brought together and seamed substantially along lines 12*a*, 14*a* spaced slightly inwardly from the edges of the respective panels. The seaming may be by stitching, welding or the like and the effect is to form an elongate tactile ridge 26 (see FIGS. 2 and 3) extending lengthwise of the holster on one side of the holster. Panels 12 and 14 define a holster pocket which may be closed at its base by an eyelet fastener 28 or the like. Edge portions 12*b* and 14*b* of the respective panels are shaped to form a recess 13 (FIGS. 2 and 3) immediately above and aligned with the ridge 26. Snap fasteners 30, 32 are provided for releasably fastening an end of flap 18 to body panel 12 as shown in FIG. 3 and have cooperating parts spaced along the length of the main body part (defined by panels 12 and 14) and the flap 18.

The completed holster is adapted to receive an elongate tear gas canister 34 with a snug fit, so that the canister cannot readily turn in the holder. Canister 34, when received in the holster, imparts a smoothly curved shape to the holster apart from ridge 26. The holster and canister are sized conveniently to fit a coat pocket or handbag and to be gripped by a user in one hand.

Canister 34 may be of a well known type having an upper cap 36 with a discharge nozzle having an operating plunger 38 and a gas discharge opening 40. When the plunger is depressed, pressurized gas is discharged through the nozzle. The cap may allow the plunger to be rotated between an operating position (shown in FIGS. 2 and 3) in which it can be depressed to discharge gas, and a safety position in which a tongue 41 of the plunger sits on a cap ledge 42 so that the plunger cannot be depressed. In the operating position, the discharge opening is located in a vertical slot 44 in the cap. This form of canister is well known and will not be described in greater detail.

The canister and holster are relatively dimensioned and configured so that in use, the slot 44 in the canister cap can be oriented to fit immediately above recess 13 in an opening of the holster defined between the main body panels and flap 18. In use, the canister is positioned in the holster in this manner. For shipping and storage, plunger 38 may be placed in the safety position and the holster flap may be closed by means of the snap fasteners.

When a user desires to carry the device in a more ready condition for emergency use, plunger 38 may be moved into the operating position and flap 18 may again be snapped closed. Plunger 38 may be operated by thumb pressure exerted on the top of flap 18 which is sufficiently flexible to permit such operation. The use of a pair, rather than one snap fastener, for securing a flap of a length to fit over top of the plunger as shown in FIG. 3, ensures that the flap cannot pivot and thus precludes pivotal movement of the flap that might obscure the discharge opening 40 and thereby interfere with proper operation of the device by the plunger.

The provision on the holster of ridge 26 promotes gripping of the holster with the ridge running down the inside of the fingers, while the remainder of the holster being smoothly curved fits readily in the palm. Accordingly, with a user knowledgeable of this fact, in an emergency situation, when the user makes a grab for the device, he or she will, by feeling the ridge, be immediately aware of the direction of gas discharge and can immediately properly orientate the holster to direct the discharge opening of the nozzle away from the user and towards an assailant. The ridge therefore provides tactile means distinguishable by feel from the remainder of the holster's outer surface for protecting a user against misdirection of the gas discharge.

The eyelet fastener 28 may be used to attach the device, for example, to a key chain.

Figure 4:
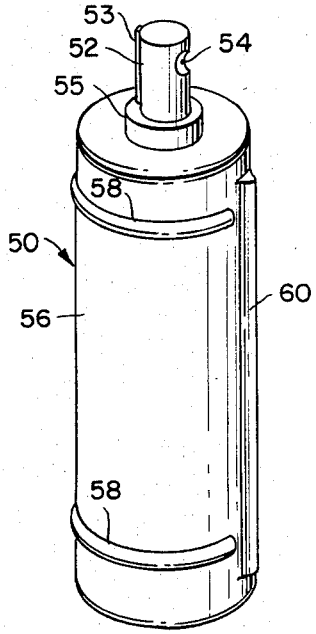
FIG. 4 is a perspective view of one form of pressurized gas canister in accordance with the invention.

In the embodiment of the invention shown in FIG. 4, an elongate canister 50 for pressurized gas, such as tear gas, may have a nonrotatable, depressible plunger 52 for operating a nozzle having a gas discharge nozzle opening 54 at one side of the canister. Plunger 52 may, for example, have a ridge 53 fitting in a slot in collar 55 to prevent rotation of the plunger to a position at which the discharge opening would face the opposite side of the canister. The body 56 of the canister, which may, for example, be rolled from metal sheet, may be formed with conventional circumferential reinforcing ridges 58. Additionally, the body may be formed with an integral elongate rib 60 extending lengthwise of the cansiter at the same side as discharge opening 54.

It will be understood that canister 50, when filled with tear gas, may be useful per se as a personal security device, in like manner to the device of the previous embodiment, and with rib 60 performing the same function as ridge 26.

Figure 5:
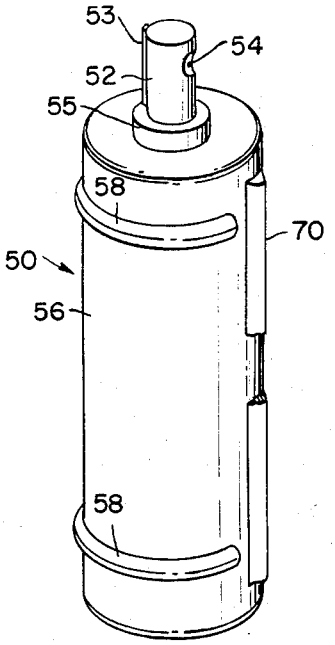
FIG. 5 is a perspective view of another form of pressurized gas canister in accordance with the invention.

In a further embodiment shown in FIG. 5, in place of a rib formed integrally with the canister body, as in the FIG. 4 arrangement, a separate rib 70 may be attached to the canister in the correct orientation to perform the same function as rib 60. Rib 70 may, for example, be attached to the canister body by adhesive or other suitable means. The canister may then be used in the same manner as previously.

It will be understood from the foregoing that the invention provides improved gas canisters and personal security devices employing same, which, by the provision thereon of the disclosed tactile means, allows a user immediately on grasping the canister to ascertain the discharge path of gas from the canister and thereby to properly orient the same to avoid misdirected gas discharge.

While only preferred embodiments of the invention have been described herein in detail, the invention is not limited thereby and modifications may be made within the scope of the attached claims.

The two embodiments previously described may be used together, with ridge 60 (or 70) on the canister fitting into the interior space provided by the holster ridge construction (12*a* to 14*a* forming 26) thus preventing the canister from rotating inside the holster, further insuring proper alignment of the discharge in the direction of ridge 26.

While the description throughout refers to tear gas and other gas, it will be understood that the invention is applicable to any type of gas or liquid or other material dispensed directionally from a hand held canister.

I claim:

1. A personal security device comprising, in combination, an elongate canister having a discharge nozzle with an operating plunger at the top of the canister adapted to be depressed by thumb pressure for discharging from the canister contents such as tear gas, and an elongate holster in which the canister is received snugly with the nozzle having a discharge opening at one side of the holster, the holster including a main body part and a fold-over flap with fastener means to secure an end of the flap to the main body part with the flap extending over the nozzle and with the flap and the main body part defining an opening by which the contents of the canister may be discharged through the nozzle at said one side of the holster, the flap being sufficiently flexible to permit the thumb of a user's hand to depress the plunger of the nozzle while the canister is in the holster, the fastener means comprising a pair of snap fasteners having cooperating parts spaced along the length of the flap and the main body part, the flap being of a length to fit over top of the plunger and to preclude pivoting of the flap by thumb pressure that could cause the flap to obscure the discharge opening, the main body part of the holster having an elongate ridge extending along the length of said one side of the holster to engage fingers of said hand and the opposite side of the holster being smoothly curved along its length to fit the palm of the hand, whereby when the device is grasped in the user's hand in an emergency, the fingers engage said ridge by feel and the smoothly curved side of the holster fits in the palm of the user's hand, with the thumb on the flap, and the discharge opening is aimed toward an assailant automatically when the ridge is oriented toward the assailant.

* * * * *